US006008717A

United States Patent [19]

Kawase et al.

[11] Patent Number: 6,008,717

[45] **Date of Patent: *Dec. 28, 1999**

[54] NTC THERMISTOR ELEMENTS

[75] Inventors: Masahiko Kawase, Kyoto; Minoru Shimada, Shiga, both of Japan

[73] Assignee: Murata Manufacturing Co., Ltd., Kyoto, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 09/003,837

[22] Filed: Jan. 7, 1998

[30] Foreign Application Priority Data

Mar. 4, 1997 [JP] Japan ..... 9-049256

[51] Int. Cl.[6] ..... H01C 7/10

[52] U.S. Cl. ..... 338/22 R; 338/20; 338/21

[58] Field of Search ..... 338/20, 21, 22 R

[56] References Cited

U.S. PATENT DOCUMENTS

| | | | |
|---|---|---|---|
| 3,962,145 | 6/1976 | Matsuo et al. | 252/519 |
| 4,347,166 | 8/1982 | Tosaki et al. | 252/519 |
| 4,906,512 | 3/1990 | Roess | 428/192 |
| 5,119,062 | 6/1992 | Nakamura et al. | 338/20 |
| 5,245,309 | 9/1993 | Kawase et al. | 338/22 R |

FOREIGN PATENT DOCUMENTS

| | | |
|---|---|---|
| 2137804 | 6/1987 | Japan . |
| 62-137804 | 6/1987 | Japan . |
| 4-130702 | 5/1992 | Japan . |
| 4130702 | 5/1992 | Japan . |
| 5-54681 | 8/1993 | Japan . |
| 5-299201 | 11/1993 | Japan . |
| 2627972 | 4/1997 | Japan . |

*Primary Examiner*—Michael L. Gellner
*Assistant Examiner*—Richard K. Lee
*Attorney, Agent, or Firm*—Majestic, Parsons, Siebert & Hsue P.C.

[57] ABSTRACT

An NTC thermistor element has a pair of outer electrodes formed on opposite outer end surfaces of a thermistor body made of an NTC thermistor material. A plurality of inner electrodes are formed inside this thermistor body in layers, each connected to either of this pair of outer electrodes. At least one of these layers contains a longer inner electrode and a shorter inner electrode disposed mutually opposite to each other, separated by a gap, and connected to different ones of this pair of outer electrodes. At least a portion of this longer electrode in this layer overlaps, in the perpendicular direction to the layers, another of the inner electrodes connected to the different outer electrode from the one to which this longer electrode is connected, with a thermistor layer in between.

20 Claims, 5 Drawing Sheets

NTC THERMISTOR ELEMENTS

BACKGROUND OF THE INVENTION

This invention relates to a thermistor element having resistance with negative temperature coefficient (hereinafter referred to as an NTC thermistor element) and more particularly to an improvement in the kinds of NTC thermistor element having a plurality of inner electrodes inside its thermistor body.

NTC thermistor elements are widely in use for detecting the temperature of the atmosphere, solid and liquid materials, as well as for compensating for changes in the characteristics of a circuit or its component due to temperature variations. As disclosed in Japanese Patent Publications 4-130702 and 62-137804, for example, prior art NTC thermistor element chips may be of a face-to-face type having electrodes disposed opposite each other in a coplanar relationship or a layered type having a plurality of inner electrodes disposed one above another inside the thermistor body in a layered formation.

FIG. 11 shows a prior art NTC thermistor element 61 of a face-to-face type having a thermistor body 62 obtained by sintering a plurality of transition metal oxides such as nickel oxide and cobalt oxide, containing therein inner electrodes 63 and 64 opposite each other at a certain height with a specified gap therebetween. An outer electrode 65 is formed over one end surface (on the left-hand side) of the thermistor body 62 and connected to one of the inner electrodes 63, and another outer electrode 66 is formed over the other end surface (on the right-hand side) of the thermistor body 26 and connected to the other inner electrode 64. The resistance value of this NTC thermistor element 61 is determined by the gap between the mutually opposite inner electrodes 63 and 64. Since the two inner electrodes 63 and 64 are in a coplanar relationship, the resistance value of the NTC thermistor element 61 can be controlled to a high degree of accuracy by accurately forming these inner electrodes 63 and 64 on a so-called green sheet which is used for obtaining the thermistor body 62.

FIG. 12 shows another example of prior art NTC thermistor element 67 of the face-to-face type characterized as having other pairs of inner electrodes 68*a*, 68*b*, 69*a*, 69*b*, 70*a* and 70*b* in addition to the electrodes 63 and 64 as shown in FIG. 11, that is, four pairs of mutually opposite electrodes at four different heights inside the thermistor body.

FIG. 13 shows an NTC thermistor element 71 of a layered type having a plurality of inner electrodes 73, 74 and 75 disposed overlappingly one above another through thermistor layers inside a thermistor body 72. Inner electrodes 73 and 75 are connected to an outer electrode 76 formed over one end surface of the thermistor body 72, and inner electrode 74 is connected to another outer electrode 77 formed over the other end surface of the thermistor body 72. With this NTC thermistor element 71, the resistance value is determined by the separations between the upper and lower inner electrodes 73 and 75 and the middle inner electrode 74. Thus, a thermistor element with a small resistance value can be more easily obtained by this type.

In summary, prior art NTC thermistor elements of the face-to-face type, as shown at 61 and 67, are advantageous wherein their resistance values can be accurately controlled but it is difficult to reduce their resistance values. The resistance value can be reduced by reducing the gap between the mutually opposite pair of inner electrodes (such as between electrodes 63 and 64) but the possibility of occurrence of a short circuit increases if the gap is reduced excessively. In other words, there is a limit beyond which the resistance value of an NTC thermistor element cannot be reduced. Another problem is that edge portions of the outer electrodes 65 and 66 extending in the direction of a line connecting the two end surfaces serve as parallel resistors with the inner electrodes, and their effect on the total resistance value is not negligible.

With an NTC thermistor element of the layered type, such as shown at 71, the resistance value can be reduced by increasing the number of layers of the inner electrodes, but there are fluctuations in the thickness of green sheets which are used for the production, and the resistance value may vary significantly, caused by such fluctuations as well as the accuracy in overlapping the green sheets. In other words, although NTC thermistor elements with low resistance values can be obtained, the more the resistance value is reduced, the greater becomes the variation in the resistance value.

SUMMARY OF THE INVENTION

It is therefore an object of this invention to provide NTC thermistor elements with low resistance values, having small fluctuations in their resistance values.

An NTC thermistor element according to this invention, with which the above and other objects can be accomplished, may be characterized as comprising a thermistor body made of an NTC thermistor material, a pair of outer electrodes on its outer surface, say, at mutually opposite ends, and a plurality of inner electrodes stacked in layers inside this thermistor body and each connected to either of this pair of outer electrodes. At least one of these layers contains a longer (referred to as the first) inner electrode and a shorter (referred to as the second) inner electrode disposed mutually opposite to each other, separated by a gap, and connected to different ones of this pair of outer electrodes. At least a portion of this longer first electrode in such a layer overlaps, in the perpendicular direction to the layers, another of the inner electrodes connected to the different outer electrode from the one to which this longer first electrode is connected, with a thermistor layer in between.

If at least two of the layers each contain a longer first inner electrode and a shorter second inner electrode which are disposed opposite each other with a gap therebetween and connected to different ones of the outer electrodes and if the first inner electrodes in these two layers are connected to different ones of these two outer electrodes, the requirement of this invention may be stated that they overlap at least in part in the perpendicular direction to the layers with a thermistor layer therebetween.

Preferably one, and more preferably both, of the outermost layers should be of the type having two such longer and shorter electrodes opposite to each other and separated by a gap. If all of the layers are of this type, it is still more preferred.

In all such embodiments of the invention, it is preferred if each of the outer electrodes is formed so as not to overlap any of the longer first electrodes connected to the other of the outer electrodes. The distance between either of the outer electrodes and any of the inner electrodes connected to the other of the outer electrodes should preferably be greater than the gap between the first and second electrodes. The first electrode in any of the layers should also preferably have a different width from another inner electrode that is in the adjacent layer and they should overlap each other in the perpendicular direction.

BRIEF DESCRIPTION OF THE DRAWINGS

The accompanying drawings, which are incorporated in and form a part of this specification, illustrate an embodiment of the invention and, together with the description, serve to explain the principles of the invention. In the drawings.

DETAILED DESCRIPTION OF THE INVENTION

Figure 1:
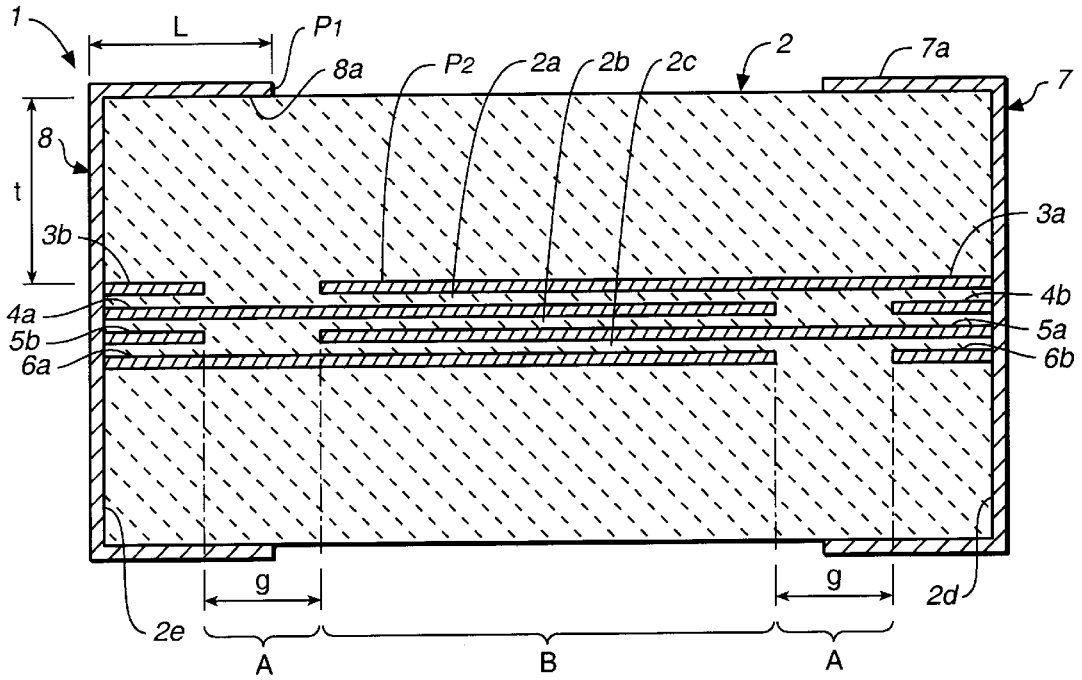
FIG. 1 is a sectional view of an NTC thermistor element according to a first embodiment of this invention.

FIG. 1 shows an NTC thermistor element 1 according to a first embodiment of this invention, comprising a columnar thermistor body 2 with a rectangular cross-sectional shape, which may be a sintered body comprising a plurality of oxides of transition metals such as nickel, cobalt and copper. The thermistor body 2 may be obtained by stacking a plurality of ceramic green sheets, some having inner electrodes (to be described below) formed on the upper surface and some having no electrodes formed thereon, and sintering the layered structure thus obtained.

Inside the thermistor body 2, there are a plurality of pairs of inner electrodes formed, each pair comprising a longer electrode and a shorter electrode (hereinafter referred to respectively as the first and second electrodes) in a coplanar relationship and separated by a specified gap. Explained more in detail, a first pair of inner electrodes is formed at a certain height inside the thermistor body 2, consisting of a longer first electrode 3*a* and a shorter second electrode 3*b*, a second pair is formed therebelow with its longer first electrode 4*a* and shorter second electrode 4*b*, a third pair is formed still therebelow with its longer first electrode 5*a* and shorter second electrode 5*b*, and a fourth pair is formed further therebelow with its longer first electrode 6*a* and shorter second electrode 6*b*. Thus, the first electrodes 3*a*, 4*a*, 5*a* and 6*a* are each coplanar with and longer than a corresponding one of the second electrodes 3*b*, 4*b*, 5*b* and 6*b*, and separated therefrom by a gap g. The resistance value determined by this gap g can be accurately set if, for example, the first and second electrodes of each pair (such as 3*a* and 3*b*) are formed on a ceramic green sheet by a printing method using a conductive paste.

As shown in FIG. 1, furthermore, the first electrode 3*a* of the first pair overlaps the first electrode 4*a* of the second pair in the direction of the thickness with a ceramic layer 2*a* therebetween. Similarly, the first electrodes 4*a* and 5*a* of the second and third pairs respectively overlap each other with another ceramic layer 2*b* therebetween, and the first electrodes 5*a* and 6*a* of the third and fourth pairs respectively overlap each other with still another ceramic layer 2*c* therebetween. As shown in FIG. 1, the ceramic layers 2*a*, 2*b* and 2*c* have a thickness which is smaller than the gap g between each pair of inner electrodes 3*a*, 4*a*, 5*a* or 6*a*, and 3*b*, 4*b*, 5*b* or 6*b*. In summary, since the four first electrodes 3*a*–6*a* are stacked one above another with ceramic layers 2*a*–2*c* in between, there is a resistance value associated with a center portion indicated by letter B as in the case of a prior art thermistor element of a layered type.

Thus, the resistance value of the NTC thermistor element 1 can be reduced if the number of the mutually overlapping longer first electrodes is increased. Although another resistance value is associated with each other sandwiching side regions indicated by letters A in FIG. 1, fluctuations in this resistance value can be reduced because the length of the gap g between the first and second electrodes of each pair can be accurately controlled. In summary, NTC thermistor elements such as shown at 1 with a small resistance value and small deviations in the resistance value can be obtained according to this invention by combining the structural features of prior art thermistor elements of face-to-face and layered types.

To produce the NTC thermistor element 1, a plurality of ceramic green sheets made of a thermistor material, adapted to function as an NTC thermistor, are prepared, including one (shown at 9*a* in FIG. 2) having no electrode printed on its rectangular upper surface, another (shown at 9*b*) having a pair of longer first and shorter second electrodes 3*a* and 3*b* printed, for example, with conductive paste containing Ag-Pd powder, and still other sheets 9*c* and 9*d* similarly formed, each having a longer first electrode 4*a* or 5*a* and a shorter second electrode 4*b* or 5*b*. Although not shown in FIG. 2, the electrodes 6*a* and 6*b*, shown in FIG. 1, are also formed similarly on still another ceramic green sheet.

Figure 3:
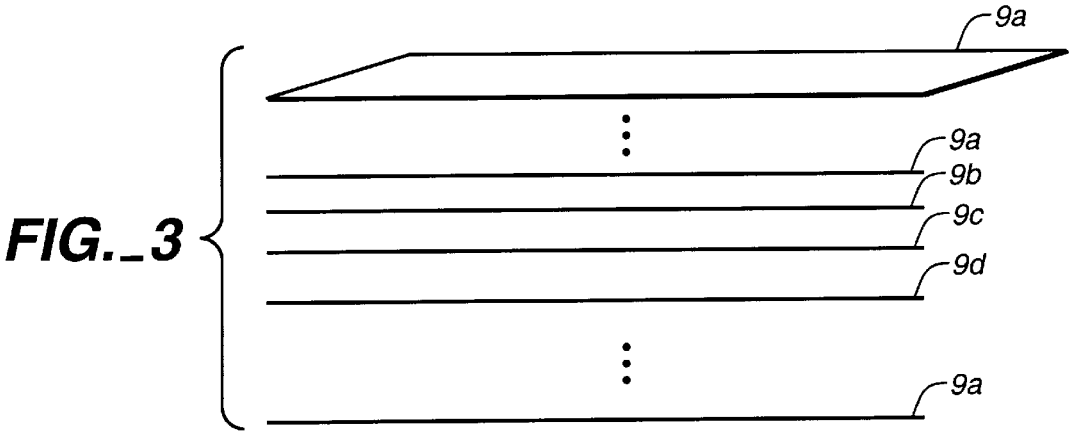
FIG. 3 is a schematic diagonal view of the NTC thermistor element of FIG. 1 for showing a step in the production thereof.

Next, a group of ceramic green sheets 9*a*, 9*b*, . . . are stacked one on top of another as shown in part in FIG. 3 and the thermistor body 2 is obtained by sintering together. Appropriate plural numbers of electrodeless ceramic green sheets, each as shown at 9*a*, may be used above and below the thermistor body 2 in this process.

Next, outer electrodes 7 and 8 are formed so as to each cover one of the mutually opposite end surfaces 2*d* and 2*e* of the thermistor body 2 as shown in FIG. 1, for example, by coating them with a conductive paste containing conductive powder such as Ag and subjecting them to a burning process. The outer electrodes 7 and 8 are not only formed on the end surfaces 2*d* and 2*e* but also extended somewhat over the upper, lower and both side surfaces of the thermistor body 2 connecting its end surfaces 2*d* and 2*e* (although FIG. 1 fails to show the portions extended on the side surfaces). These extended portions on the upper, lower and side surfaces are hereinafter referred to as the sleeve parts 7*a* and 8*a* of the outer electrodes 7 and 8, respectively. First electrodes 3*a* and 5*a* and second electrodes 4*b* and 6*b* are connected to the outer electrode 7 on the right-hand side and first electrodes 4*a* and 6*a* and second electrodes 3*b* and 5*b* are connected to the outer electrode 8 on the left-hand side.

Figure 2:
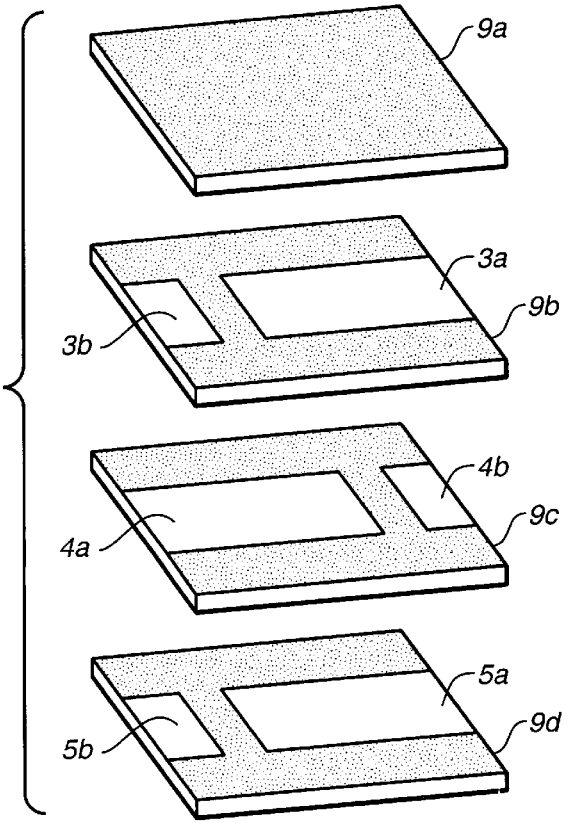
FIG. 2 is an exploded diagonal view of some of the components which are used to produce the NTC thermistor element shown in FIG. 1.
Figure 4A:
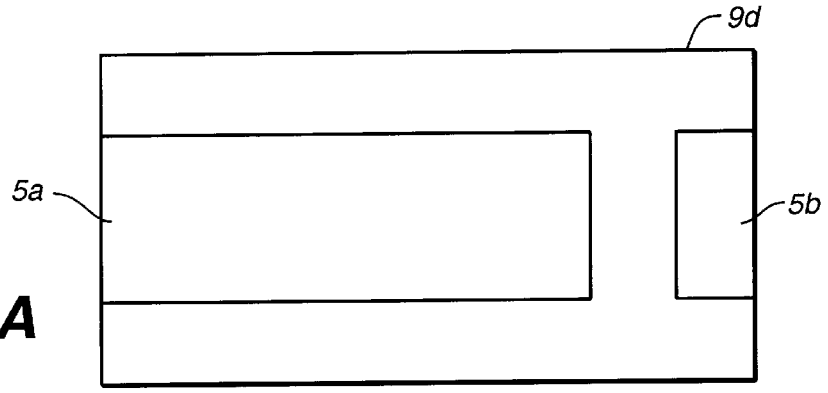
FIGS. 4A and 4B are plan views of two of the layers having electrodes with different widths.
Figure 4B:
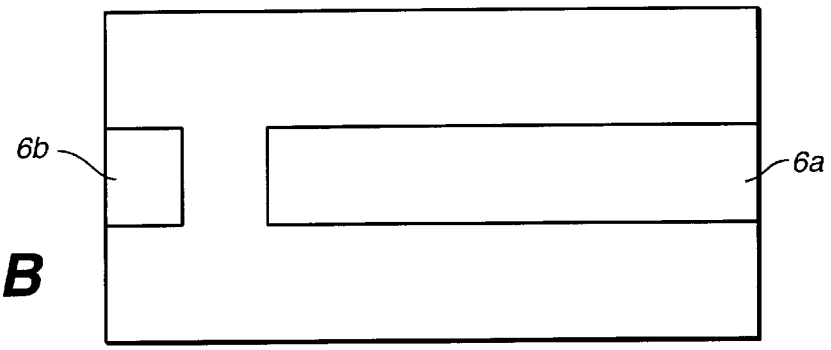

FIG. 2 shows the first electrodes 3*a*, 4*a* and 5*a* as having the same width, the "width" being defined in the direction perpendicular to the direction between the two end surfaces 2*d* and 2*e* of the thermistor body 2 on a green sheet. It is preferable, however, to vary the widths of the first electrodes stacked one above another with thermistor layers inserted therebetween because the variations in the resistance value finally obtained can thus be further reduced. If the first electrode 5*a* is formed wider than the first electrode 6*a* which is adjacent thereto with a thermistor layer therebetween, as shown in FIG. 4A and 4B, variations in the resistance value caused by displacements in the direction of width at the time of stacking these layers can be reduced. Although the electrodes 5*a* and 6*a* are not accurately printed and/or the layers are not accurately stacked together, the area of their mutually overlapping portions does not vary as long as the narrower first electrode 6*a* is within the area of the wider first electrode 5*a* projected onto the plane of the former.

Figure 5A:
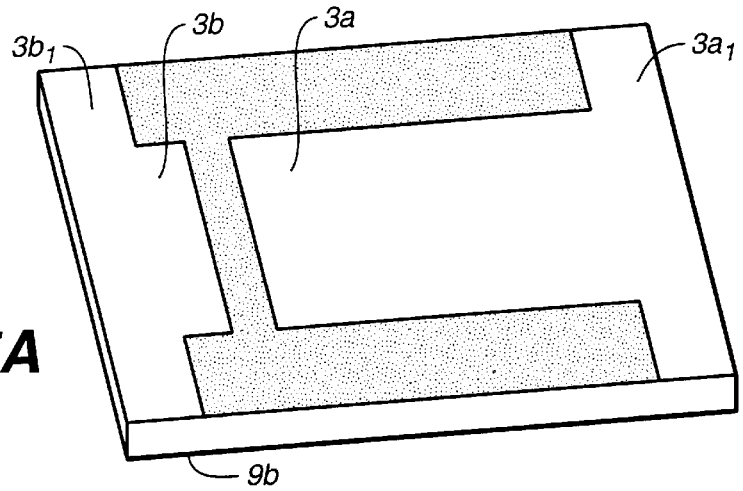
FIGS. 5A and 5B are diagonal views showing inner electrodes with different shapes.

As another embodiment of the invention, each or any pair of first and second inner electrodes (shown as an example in FIG. 5A by the first pair 3*a* and 3*b* of FIG. 1) may be formed with edge parts 3*a*1 and 3*b*1 extending along and over the entire width of the ceramic green sheet 9*b*. These edge parts 3*a*1 and 3*b*1 serve to improve the reliability of electrical contacts between the inner electrodes 3*a* and 3*b* with the outer electrodes 7 and 8. Since the main parts of first and second electrodes 3*a* and 3*b* are narrower than the ceramic green sheet 9*b*, retracted from its side edges, this embodiment also serves to improve the moisture-resistance property.

Figure 5B:
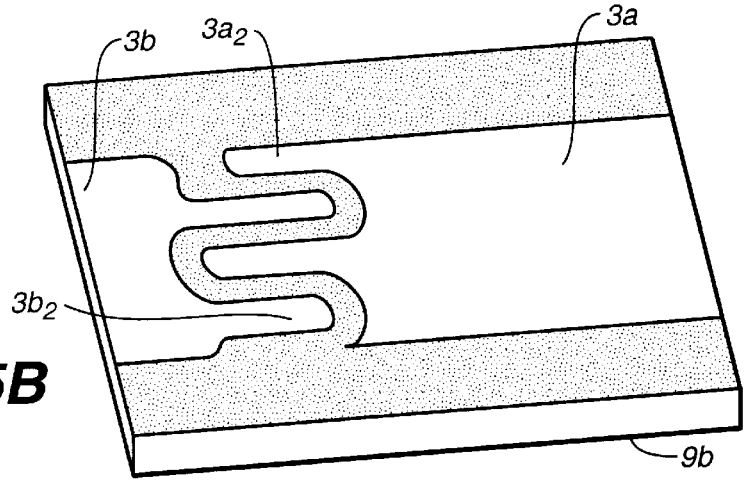

As still another embodiment of the invention, each or any pair of first and second inner electrodes (shown again as an example in FIG. 5B by the first pair 3*a* and 3*b*) may be formed in a comb-like shape having electrode fingers 3*a*2 and 3*b*2 interdigitally inserted between each other at the tip. With the first and second electrodes thus formed interdigitally opposite each other, further reduction in resistance value can be achieved.

Next, the merits of this invention (that is, reduction in resistance value and variations in resistance values) will be demonstrated by way of a test experiment. For this experiment, a plurality of ceramic green sheets having oxides of Mn, Ni and Co as main components were provided and pairs of mutually opposite first and second electrodes 3*a*, 3*b*–6*a*, 6*b* were printed each on a different one of them. The ceramic green sheets thus obtained with pairs of electrodes printed thereon were stacked one on top of another and suitable numbers of ceramic green sheets without any electrodes printed thereon were stacked thereabove and therebelow. The stack thus formed was sintered and outer electrodes 7 and 8 were formed by coating the thermistor body thus obtained with electrodes comprising Ag and subjecting them to a burning process. Sample NTC thermistor elements according to the first embodiment of this invention were thus prepared by varying the number (=N) of pairs of inner electrodes. Their resistance values R and their "3CV" deviation values $R_{3CV}$, were as shown in Table 1.

Figure 12:
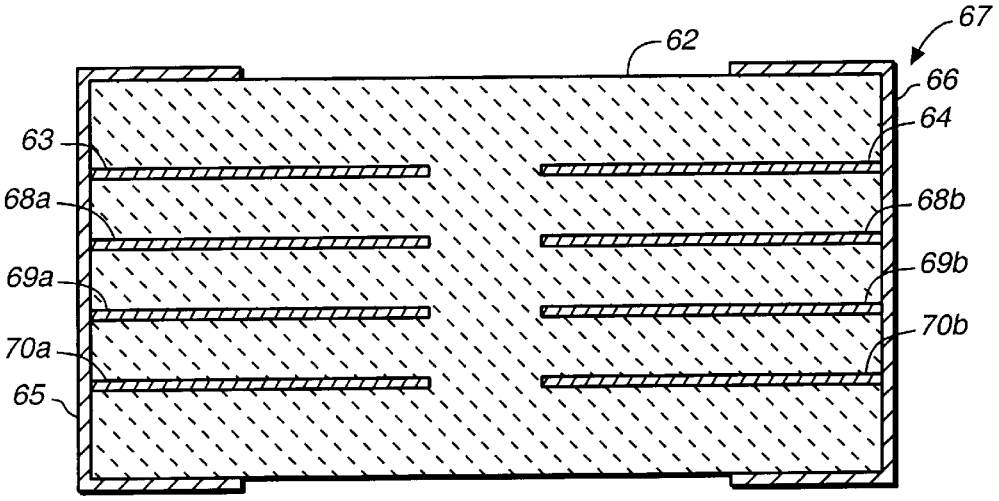
FIG. 12 (PRIOR ART)
FIG. 12 is a sectional view of another prior art NTC thermistor element of a face-to-face type.
Figure 13:
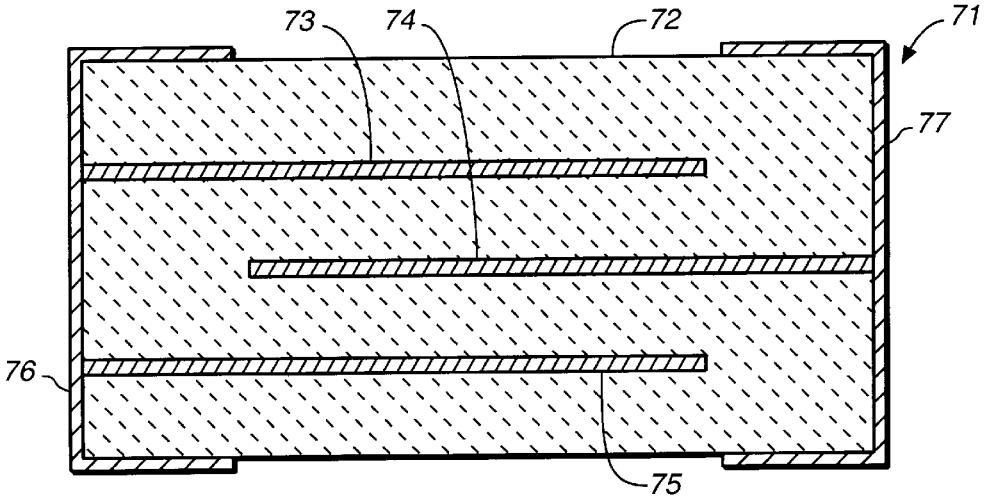
FIG. 13 (PRIOR ART)
FIG. 13 is a sectional view of a prior art NTC thermistor element of a layered type.

For comparison, prior art NTC thermistor elements of the face-to-face and layered types, as shown at 67 and 71 respectively in FIGS. 12 and 13, were produced by using the same materials as described above for making the test samples and with the same dimensions. The numbers (=N) of pairs of inner electrodes were also varied to obtain comparison samples of NTC thermistor elements. Their resistance values R and deviations $R_{3CV}$ were obtained and are also shown in Table 1.

TABLE 1

| | | | Comparison Examples | | | | | |
|---|---|---|---|---|---|---|---|---|
| First Embodiment | | | Face-to-face Type | | | Layered Type | | |
| N | R (kΩ) | (%) | N | R (kΩ) | $R_{3CV}$ (%) | N | R (kΩ) | $R_{3CV}$ (%) |
| 2 | 1.30 | 6 | 1 | 5.8 | 7 | 2 | 1.59 | 25 |
| 3 | 0.62 | 5 | 3 | 3.6 | 6 | 3 | 0.78 | 18 |
| 4 | 0.41 | 4 | 5 | 2.5 | 5 | 4 | 0.50 | 15 |
| 6 | 0.25 | 3.6 | | | | 5 | 0.32 | 15 |
| 9 | 0.15 | 3.4 | | | | 10 | 0.16 | 15 |

Table 1 clearly shows that the resistance deviation $R_{3CV}$ can be reduced by NTC thermistor elements of the face-to-face type because resistance values are determined by the gap. It is very large, however, with NTC thermistors of the layered type for various reasons such as inaccuracies in stacking, printing and cutting the mother sheet to obtain the individual ceramic green sheets. Table 1 also shows that an NTC thermistor element according to the first embodiment of the invention has a much smaller resistance value than a similar prior art NTC thermistor element of the face-to-face type with the same number of layers of inner electrodes. Although small resistance values can be obtained with a prior art NTC thermistor element by increasing the number of layers of inner electrodes, Table 1 indicates that a significantly large number of layers would have to be stacked in order to obtain a resistance value lower than 1 kΩ and hence that the thickness would have to be increased.

Next, the number of inner electrodes of the NTC thermistor elements according to the first embodiment of the invention was varied and corresponding changes in their resistance value and their deviations $R_{3CV}$ were measured and obtained. The results are shown in FIGS. 6 and 7.

Figure 6:
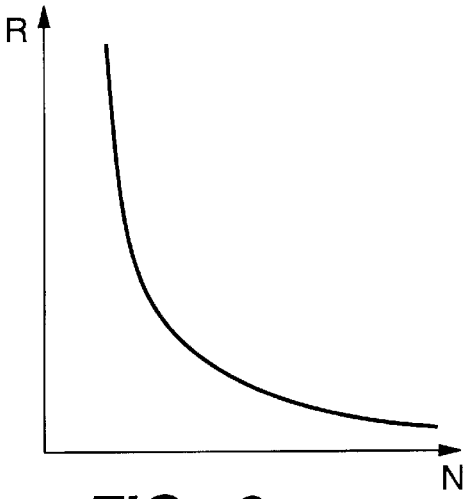
FIG. 6 is a graph which shows the relationship between the number of layers and resistance value of an NTC thermistor element as shown in FIG. 1.
Figure 7:
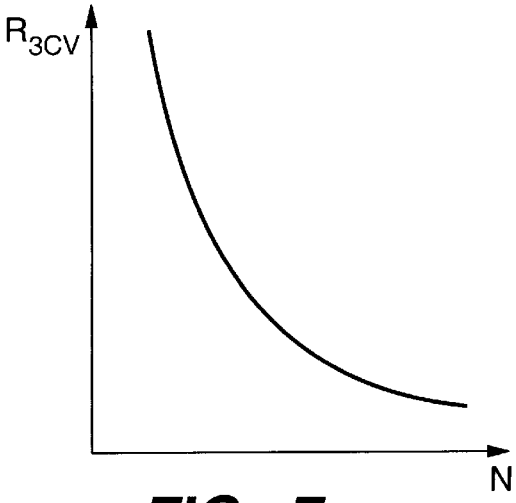
FIG. 7 is a graph which shows the relationship between the number of layers and deviation $R_{3CV}$ of resistance value of an NTC thermistor element as shown in FIG. 1.

FIGS. 6 and 7 clearly show that resistance values can be reduced significantly according to this invention if the number of layers of the inner electrodes is increased. This means that NTC thermistor elements having a desired low resistance value can be produced with a high degree of accuracy by appropriately increasing or decreasing the number of pairs (layers) of inner electrodes (each comprising a longer first electrode and a shorter second electrode).

Figure 8:
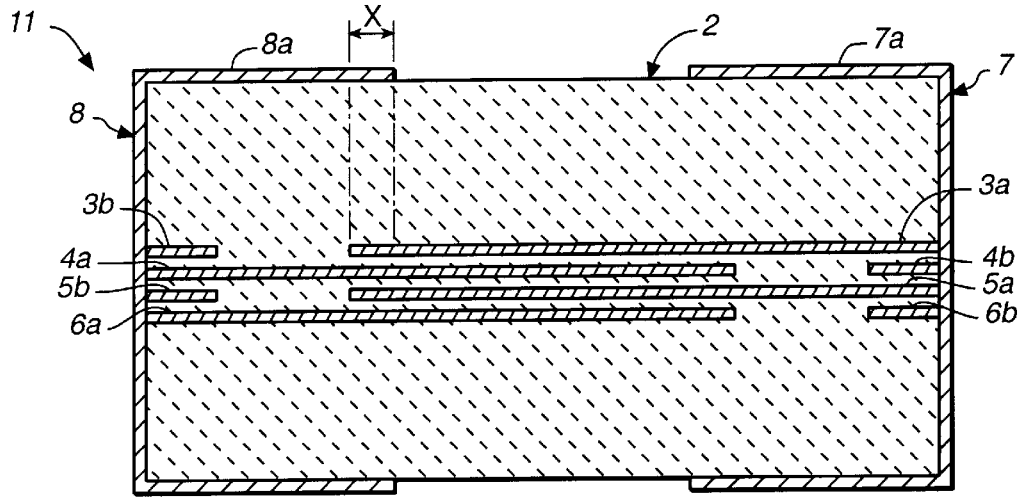
FIG. 8 is a sectional view of a thermistor element for showing the overlapping relationship between the sleeve portion of an outer electrode and mutually opposing inner electrodes.

The sleeve parts 7*a* and 8*a* of the outer electrodes 7 and 8 of the NTC thermistor element 1 according to the first embodiment of the invention are preferably formed so as not to overlap (in the direction of the thickness) any of the inner electrodes connected to the opposite outer electrode 7 or 8. This serves to further reduce the deviations of the resistance values. This will be explained next in detail with reference to FIGS. 1 and 8.

As shown in FIG. 1, the sleeve part 8*a* of the outer electrode 8 of the NTC thermistor element 1 is disposed so as not to overlap the first electrode 3*a* of the first pair of inner electrodes connected to the opposite outer electrode 7. With thermistor elements thus structured, the length L of the sleeve part 8*a* (defined as the distance between the outer end surface 2*e* of the outer electrode 8 and the top $P_1$ of the sleeve part Ba) and the horizontal distance between the tip of the sleeve part 8*a* and the first electrode 3*a* of the first pair were varied as shown in Table 2 to evaluate their resistance values R, their deviations $R_{3CV}$ and the fractional change from the standard taken when the overlapping distance X (to be explained below) was −0.2 mm. (Non-positive values in X mean no overlapping.) For comparison, a comparison sample NTC thermistor element as shown at 11 in FIG. 8 was produced with sleeve part 8*a* overlapping the first electrode 3*a* of the first pair of inner electrodes by an overlapping distance X=+0.1 mm, and resistance value R and its deviation $R_{3CV}$ were obtained and its fractional difference ΔR was evaluated similarly.

TABLE 2

| L (mm) | R (kΩ) | $R_{3CV}$ (%) | X (mm) | ΔR (%) |
|---|---|---|---|---|
| 0.2 | 0.410 | 5 | −0.2 | Standard |
| 0.3 | 0.410 | 5 | −0.1 | 0 |
| 0.4 | 0.409 | 5.2 | 0 | −0.02 |
| 0.5 | 0.403 | 7 | +0.1 | −1.8 |

Table 2 clearly shows that the resistance value of the comparison sample (the NTC thermistor element 11 of FIG. 8) deviates significantly from the test samples with no overlapping (that is, x<0). In other words, when the sleeve part 8*a* overlaps the first electrode 3*a* connected to the opposite outer electrode 7, a deviation in the length of the sleeve part 8*a* results in a significant deviation in the resistance value. Thus, the resistance value and its deviation $R_{3CV}$ can be further reduced if neither sleeve part (7*a* or 8*a*) of either outer electrode (7 or 8) is disposed so as to overlap the first electrode connected to the opposite outer electrode (8 or 7).

It has also been discovered with respect to the NTC thermistor element 1 according to the first embodiment of this invention that the distance between the tip $P_1$ of either sleeve part (such as 8*a*) of either outer electrode (such as 8) and the tip $P_2$ of the first electrode (such as 3*a*) connected to the opposite outer electrode (such as 7) affects the deviation of the resistance value. According to this invention, it is preferred that the distance between the tips $P_1$ and $P_2$ be made greater than the gap g between the first and second electrodes 3*a* and 3*b* of the same pair of inner electrodes such that the deviation can be reduced.

With the NTC thermistor elements 1 according to the first embodiment of this invention, the gap g was set equal to 0.25 mm, the length L of the sleeve part 8*a* of the outer electrode 8 equal to 0.3 mm, the length of the second electrode 3*b* of the first pair to 0.05 mm and the thickness t of the thermistor layer between the first pair of inner electrodes and the upper surface of the thermistor body 2 was varied as shown in Table 3 to change the distance between the tips $P_1$ and $P_2$ and to thereby evaluate the deviations of resistance values. The results are also shown in Table 3.

TABLE 3

| Thickness t (mm) | Distance p between $P_1$ and $P_2$ | $R_{3CV}$ (%) |
|---|---|---|
| 0.8 | 0.28 | 4.0 |
| 0.75 | 0.255 | 4.2 |
| 0.70 | 0.230 | 5.8 |
| 0.65 | 0.205 | 8.1 |

Table 3 shows clearly that the resistance deviation $R_{3CV}$ can be reduced if the distance p between the tips $P_1$ and $P_2$ is larger than the gap g.

Figure 9:
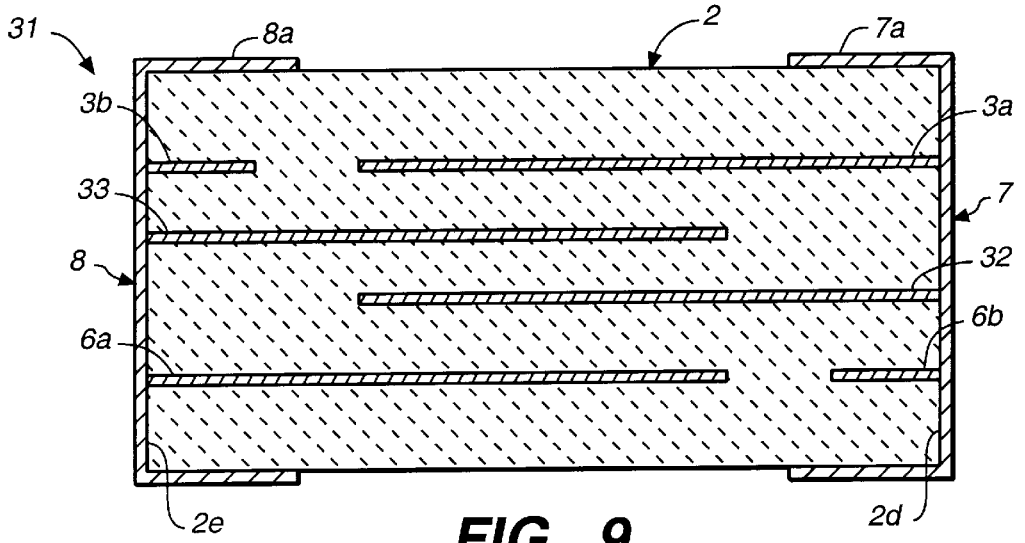
FIG. 9 is a sectional view of another NTC thermistor element according to a second embodiment of this invention.

Next, FIG. 9 is referenced to describe a second embodiment of this invention. FIG. 9 shows an NTC thermistor element 31 according to the second embodiment of this invention, having four layers of inner electrodes formed inside a columnar thermistor body 2 with a rectangular cross-sectional shape. It is structured similarly to the NTC thermistor element 1 according to the first embodiment of the invention shown above in FIG. 1 but is different therefrom in that the two of the inner electrodes 32 and 33 in the middle layers in the direction of the thickness respectively replace the second and third pairs of inner electrodes 4*a*, 4*b*, 5*a* and 5*b* of the NTC thermistor element 1 of FIG. 1.

As illustrated by this example, not every inner electrode (at a different layer) of an NTC thermistor element according to this invention is required to be formed with a longer first electrode and a shorter second electrode. In other words, as a variation to the second embodiment, an NTC thermistor element according to this invention may comprise a combination of appropriate numbers of inner electrodes each divided into a longer first electrode and a shorter second electrode and inner electrodes like those of a prior art NTC thermistor element of the layered type (that is, not divided into longer and shorter parts). In this case, too, variations in the resistance value can be accurately controlled by the gap g, as in the case of NTC thermistor elements of the face-to-face type, and the resistance value can be reduced by increasing the number of layers between first electrodes at different heights or where an NTC thermistor element of the layered type is formed. In summary, face-to-face electrodes and layered electrodes can be combined suitably and many ways of combining them are possible within the scope of this invention. It is preferable, however, that face-to-face electrodes be disposed in the outermost layers in the direction of the thickness as is the case with the NTC thermistor element 31. With the inner electrodes 32 and 33 which are structured like those of a prior art NTC thermistor of the layered type, variations in the resistance value are likely to result due to the variations in the distances between tips of the inner electrodes and the opposite outer electrodes 7 and 8, but variations due to such a cause do not occur easily with inner electrodes 3*a*, 3*b*, 6*a* and 6*b* of the face-to-face type.

Figure 10:
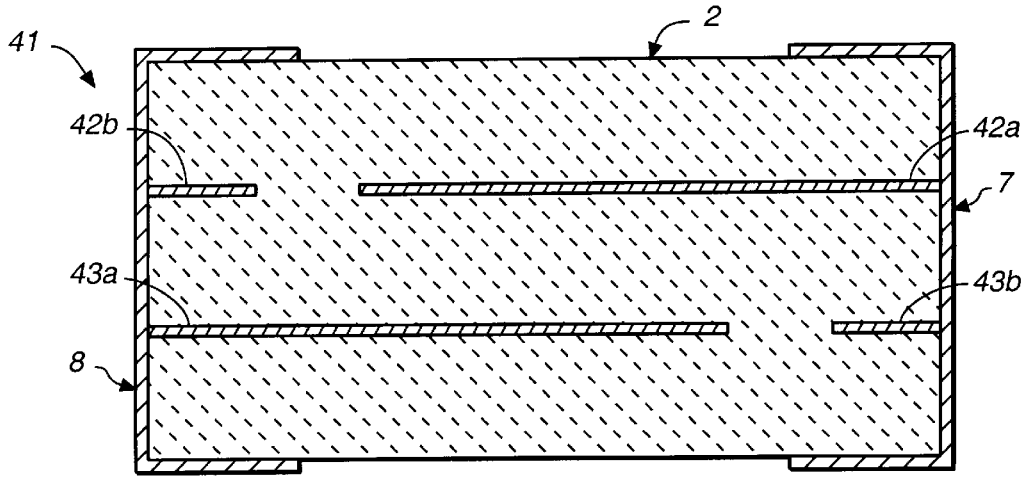
FIG. 10 is a sectional view of still another NTC thermistor element according to a third embodiment of this invention.
Figure 11:
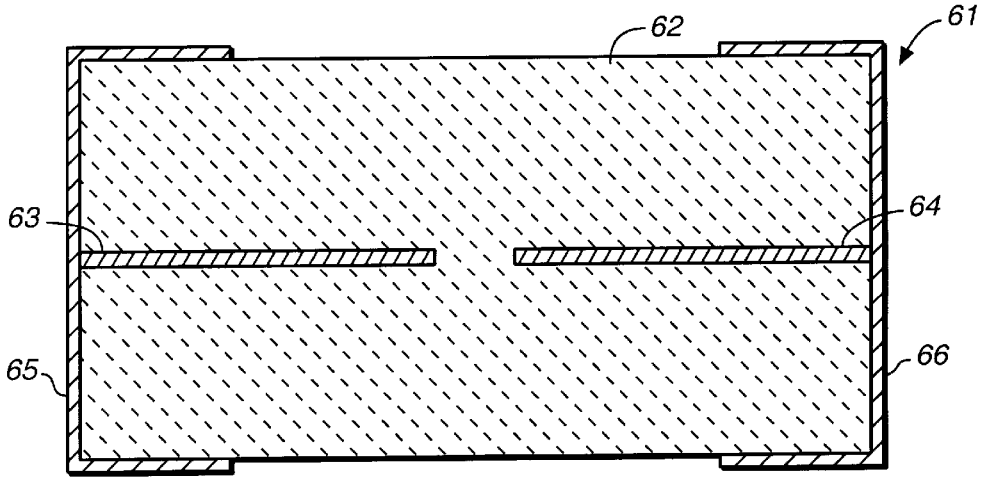
FIG. 11 (PRIOR ART)
FIG. 11 is a sectional view of a prior art NTC thermistor element of a face-to-face type.

FIG. 10 shows still another NTC thermistor element 41 according to a third embodiment of this invention having inner electrodes in two layers within a thermistor body 2, each layer containing a pair of mutually opposite electrodes in a face-to-face relationship. More in detail, the upper layer contains a longer first electrode 42*a* and a shorter second electrode 42*b* and the lower layer contains a longer first electrode 43*a* and a shorter second electrode 43*b*. A pair of outer electrodes 7 and 8 are formed on mutually opposite end surfaces of the thermistor body 2, the electrodes 42*a* and 43*b* being connected to one of the outer electrodes (7) and the electrodes 42*b* and 43*a* being connected to the other outer electrode (8). Thus, like the NTC thermistor according to the first embodiment of the invention described above, both the variations in the resistance value and the resistance value itself can be reduced. In other words, the NTC thermistor 41 shown in FIG. 10 may be considered as the most simplified form of the NTC thermistor embodying this invention.

What is claimed is:

1. An NTC thermistor element comprising:

a thermistor body made of an NTC thermistor material;

a pair of outer electrodes on outer surface of said thermistor; and a plurality of inner electrodes in layers inside said thermistor body, each of said inner electrodes being connected to either of said outer electrodes, at least one of said layers containing a longer first inner electrode and a shorter second inner electrode which are disposed opposite each other with a gap therebetween and connected to different ones of said outer electrodes, said layers being mutually separated by a distance smaller than said gap, at least a portion of said longer first inner electrode overlapping another of said inner electrodes in a direction perpendicular to said layers with a thermistor layer therebetween, said another inner electrode being connected to the different one of said pair of outer electrodes from the one to which said first inner electrode is connected.

2. The NTC thermistor element of claim 1 wherein at least two of said layers each contain a longer first inner electrode and a shorter second inner electrode which are disposed opposite each other with a gap therebetween and connected to different ones of said outer electrodes, the first inner electrodes in said two layers being connected to different ones of said outer electrodes and overlapping at least in part in a direction perpendicular to said layers with a thermistor layer therebetween.

3. The NTC thermistor element of claim 2 wherein at least one of said at least two layers is either of the outermost of said layers.

4. The NTC thermistor element of claim 2 wherein each of said inner electrodes in each of said layers includes a longer first inner electrode and a shorter second inner electrode disposed opposite each other with a gap therebetween and connected to different ones of said outer electrodes, the first inner electrodes in a mutually adjacent pair of layers being connected to different ones of said outer electrodes and at least partially overlapping each other in said perpendicular direction through a thermistor layer.

5. The NTC thermistor element of claim 3 wherein each of said inner electrodes in each of said layers includes a longer first inner electrode and a shorter second inner electrode disposed opposite each other with a gap therebetween and connected to different ones of said outer electrodes, the first inner electrodes in a mutually adjacent pair of layers being connected to different ones of said outer electrodes and at least partially overlapping each other in said perpendicular direction through a thermistor layer.

6. The NTC thermistor element of claim 2 wherein said outer electrodes are at mutually opposite ends of said thermistor body, none of said inner electrodes connected to either one of said outer electrodes overlaps the other of said outer electrodes in said perpendicular direction.

7. The NTC thermistor element of claim 3 wherein said outer electrodes are at mutually opposite ends of said thermistor body, none of said inner electrodes connected to either one of said outer electrodes overlaps the other of said outer electrodes in said perpendicular direction.

8. The NTC thermistor element of claim 4 wherein said outer electrodes are at mutually opposite ends of said thermistor body, none of said inner electrodes connected to either one of said outer electrodes overlaps the other of said outer electrodes in said perpendicular direction.

9. The NTC thermistor element of claim 5 wherein said outer electrodes are at mutually opposite ends of said thermistor body, none of said inner electrodes connected to either one of said outer electrodes overlaps the other of said outer electrodes in said perpendicular direction.

10. The NTC thermistor element of claim 2 wherein the distance between either of said outer electrodes and any of said inner electrodes connected to the other of said outer electrodes is greater than said gap.

11. The NTC thermistor element of claim 3 wherein the distance between either of said outer electrodes and any of said inner electrodes connected to the other of said outer electrodes is greater than said gap.

12. The NTC thermistor element of claim 4 wherein the distance between either of said outer electrodes and any of said inner electrodes connected to the other of said outer electrodes is greater than said gap.

13. The NTC thermistor element of claim 5 wherein the distance between either of said outer electrodes and any of said inner electrodes connected to the other of said outer electrodes is greater than said gap.

14. The NTC thermistor element of claim 6 wherein the distance between either of said outer electrodes and any of said inner electrodes connected to the other of said outer electrodes is greater than said gap.

15. The NTC thermistor element of claim 7 wherein the distance between either of said outer electrodes and any of said inner electrodes connected to the other of said outer electrodes is greater than said gap.

16. The NTC thermistor element of claim 8 wherein the distance between either of said outer electrodes and any of said inner electrodes connected to the other of said outer electrodes is greater than said gap.

17. The NTC thermistor element of claim 2 wherein the first electrode in any of said layers has a different width from any of said inner electrodes that is in an adjacent layer and overlaps therewith in said perpendicular direction.

18. The NTC thermistor element of claim 3 wherein the first electrode in any of said layers has a different width from any of said inner electrodes that is in an adjacent layer and overlaps therewith in said perpendicular direction.

19. The NTC thermistor element of claim 4 wherein the first electrode in any of said layers has a different width from any of said inner electrodes that is in an adjacent layer and overlaps therewith in said perpendicular direction.

20. The NTC thermistor element of claim 5 wherein the first electrode in any of said layers has a different width from any of said inner electrodes that is in an adjacent layer and overlaps therewith in said perpendicular direction.

* * * * *